United States Patent [19]

Moore

[11] 4,003,692

[45] Jan. 18, 1977

[54] HIGH VELOCITY BURNER

[75] Inventor: Edward E. Moore, Rockford, Ill.

[73] Assignee: Eclipse, Inc., Rockford, Ill.

[22] Filed: Aug. 6, 1975

[21] Appl. No.: 602,248

[52] U.S. Cl. ..... 431/158; 431/182; 431/284; 431/285; 431/353

[51] Int. Cl.[2] ..... F23R 1/02

[58] Field of Search ..... 431/158, 284, 285, 182, 431/187, 353, DIG. 21; 239/399, 405, 403

[56] References Cited

UNITED STATES PATENTS

| | | | |
|---|---|---|---|
| 2,941,585 | 6/1960 | Loebel et al. | 431/285 X |
| 3,163,203 | 12/1964 | Ihlenfield | 431/284 X |
| 3,418,060 | 12/1968 | Spielman et al. | 431/158 |
| 3,485,566 | 12/1969 | Schoppe | 431/158 |

*Primary Examiner*—Edward G. Favors
*Attorney, Agent, or Firm*—Leydig, Voit, Osann, Mayer & Holt, Ltd.

[57] ABSTRACT

The burner is capable of operating either on gas or fuel oil and includes a burner block with a high velocity discharge nozzle. Combustion air for the burner is rotationally spun to promote more complete combustion of the fuel and to reduce the formation of carbon deposits along the block and within the discharge nozzle. As a result of the spinning combustion air, a high rotational velocity is imparted to the flame so that the flame threads corkscrew-fashion out of the discharge nozzle and is formed with a hollow center.

4 Claims, 4 Drawing Figures

HIGH VELOCITY BURNER

BACKGROUND OF THE INVENTION

This invention relates to a burner of the same general type as disclosed in Spielman et al U.S. Pat. No. 3,418,060. In such a burner, gas and combustion air are delivered into a burner body and are ignited upon passing from the body and into a tubular burner block. An inwardly coverging nozzle is provided at the discharge end of the burner block and serves to radially contract the advancing stream of gas and air to promote efficient final combustion and to cause the flame to be discharged from the burner at a high velocity. Such a burner has experienced significant commercial success in recent years and is widely referred to as a high velocity burner.

SUMMARY OF THE INVENTION

The general aim of the present invention is to provide a new and improved high velocity burner of the foregoing type which is selectively capable of burning either fuel oil or gas and which operates with optimum effectiveness regardless of the type of fuel being used.

A further object of the invention is to provide a dual fuel, high velocity burner in which the fuel oil can be mixed and burned efficiently with low excess air without creating any significant sooting and without producing any significant carbon deposits adjacent the discharge nozzle of the burner block.

A more detailed object is to provide a dual fuel, high velocity burner in which the combustion air is rotationally spun upon entering the combustion area and imparts a vortical swirling motion to the fuel and flame to promote more complete combustion of the fuel and to create a protective boundary layer of air adjacent the tubular wall and the discharge nozzle of the burner block.

The invention also resides in the unique construction of the burner body to cause spinning and vortical swirling of the combustion air, and further is characterized by the novel coaction between the burner body and the burner block to produce a flame with high rotational and high linear velocity.

These and other objects and advantages of the invention will become more apparent from the following detailed description when taken in conjunction with the accompanying drawings.

DETAILED DESCRIPTION OF THE PREFERRED EMBODIMENT

Figure 1:
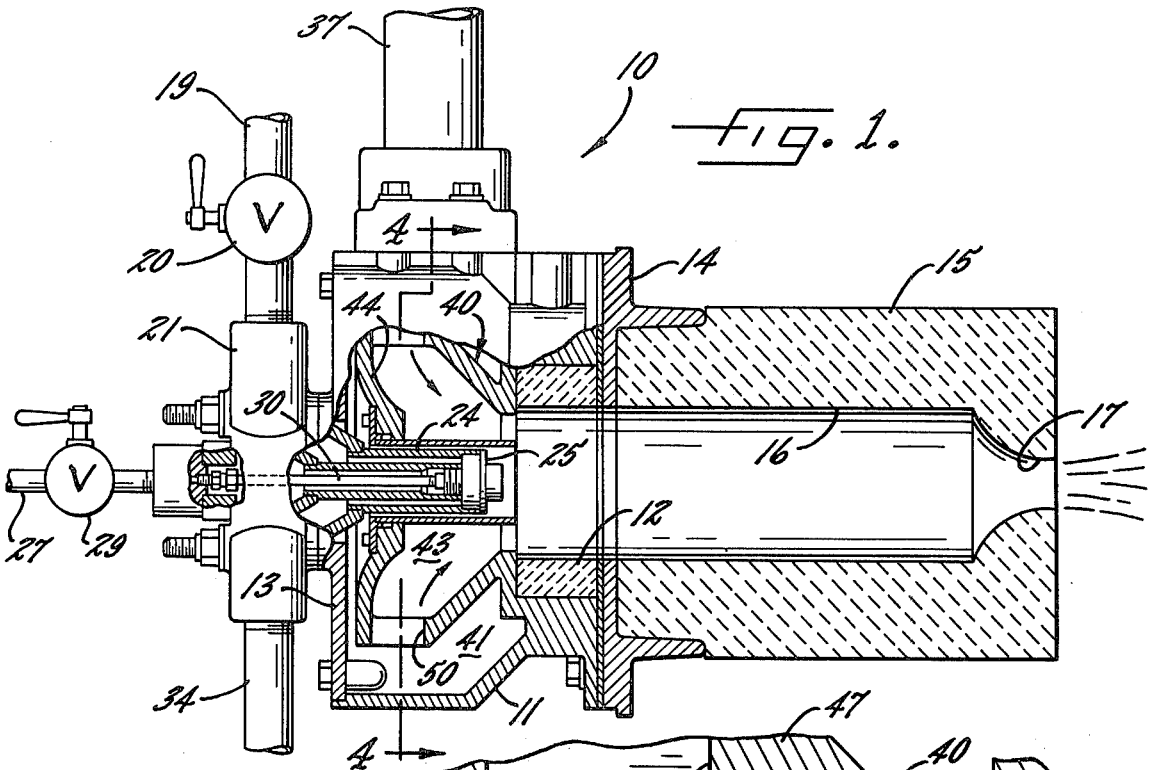
FIG. 1 is a side elevational view of a new and improved burner incorporating the unique features of the present invention, part of the burner being broken away and shown in cross-section.

As shown in the drawings for purposes of illustration, the invention is incorporated in a burner 10 in which fuel and combustion air are mixed and ignited in order to produce a high temperature flame. Herein, the burner comprises a tubular body 11 made of cast iron and closed at its upstream or rear end by a cover plate 13. The downstream or forward end of the body is left open and is fastened to a cast iron holder 14 which, in turn, supports a tubular burner block 15 made of ceramic material. A preburned refractory ring 12 is cemented to the body 11 adjacent the holder 14 to keep the cast iron components of the burner at a reasonable temperature.

The burner block 15 is of the same general type as disclosed in the aforementioned Spielman et al patent. As shown, the block includes a generally cylindrical internal wall 16 which is substantially the same diameter as the open end of the burner body 11 and which extends forwardly a substantial distance beyond the open end of the body. At its downstream end, the block is formed with an inwardly converging internal wall which defines a restricted discharge nozzle 17. The ratio of the diameter of the cylindrical wall 16 to the diameter of the discharge nozzle 17 may range from about 2.5 to 1 to about 5 to 1.

Figure 2:
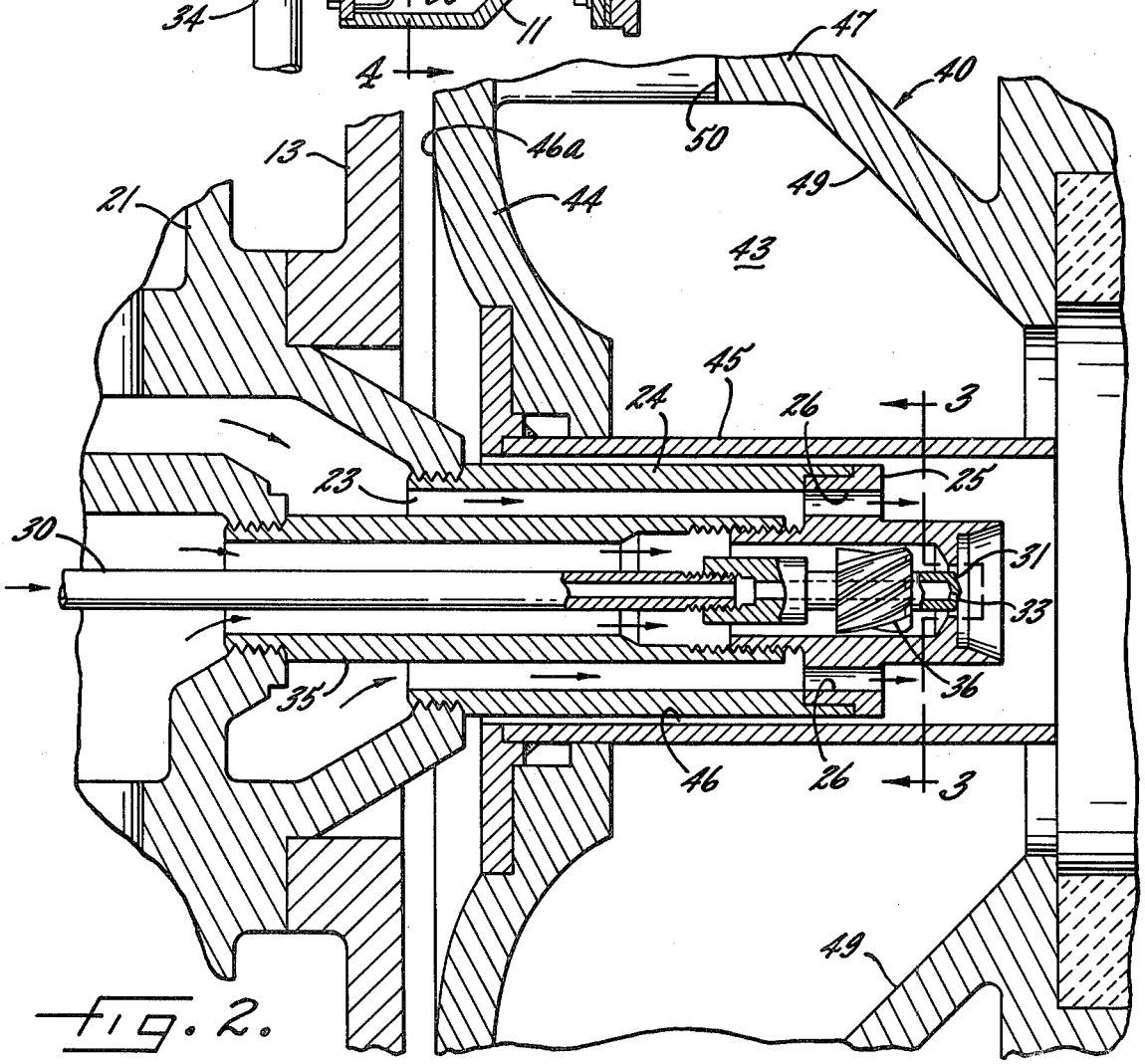
FIG. 2 is an enlarged cross-sectional view of parts shown in FIG. 1.
Figure 3:
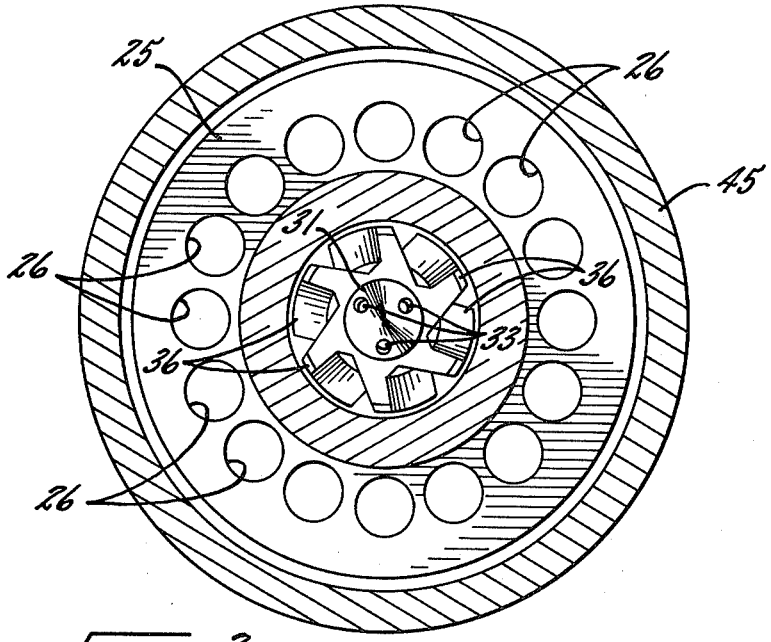
FIG. 3 is an enlarged cross-section taken substantially along the line 3—3 of FIG. 2.

Gaseous fuel may be supplied to the burner 10 through a pipe 19 and an adjustable control valve 20 and is delivered into a housing 21 which is attached to the rear end of the cover plate 13. The gas flows out of the forward end of the housing 21 and into the burner body 11 through an annular passage 23 (FIG. 2) which is defined within a sleeve 24 secured to the forward end of the housing. A nozzle 25 is fitted into the outer end of the sleeve 24 and is formed with a plurality of angularly spaced ports 26 (FIG. 3) which are alined axially with the passage 23 to divide the stream of gas into a series of jets as the gas is discharged from the sleeve.

As an alternative to gas operation, the burner 10 may be selectively operated on fuel oil. For this purpose, oil is adapted to be delivered to the burner by way of a pipe 27 (FIG. 1) and a control valve 29 and flows through the housing 21 through a small diameter tube 30 (FIG. 2). The tube extends into the sleeve 24 and is connected to an oil nozzle 31 which is disposed within the gas nozzle 25. Three angularly spaced holes 33 (FIG. 3) are formed in the forward end of the oil nozzle to cause the oil to spray out of the nozzle.

In order to break the oil up into small droplets, atomizing air is delivered into the housing 21 through a line 34 (FIG. 1) and flows through a tube 35 (FIG.2) which is telescoped into the sleeve 24 and over the tube 30. Upon leaving the tube 35, the atomizing air encounters and is spun by helically extending and circumferentially spaced vanes 36 (FIGS. 2 and 3) formed around the oil nozzle 31. The atomizing air is discharged adjacent the holes 33 and causes the oil to spray into the burner block 15 as a fine mist.

Figure 4:
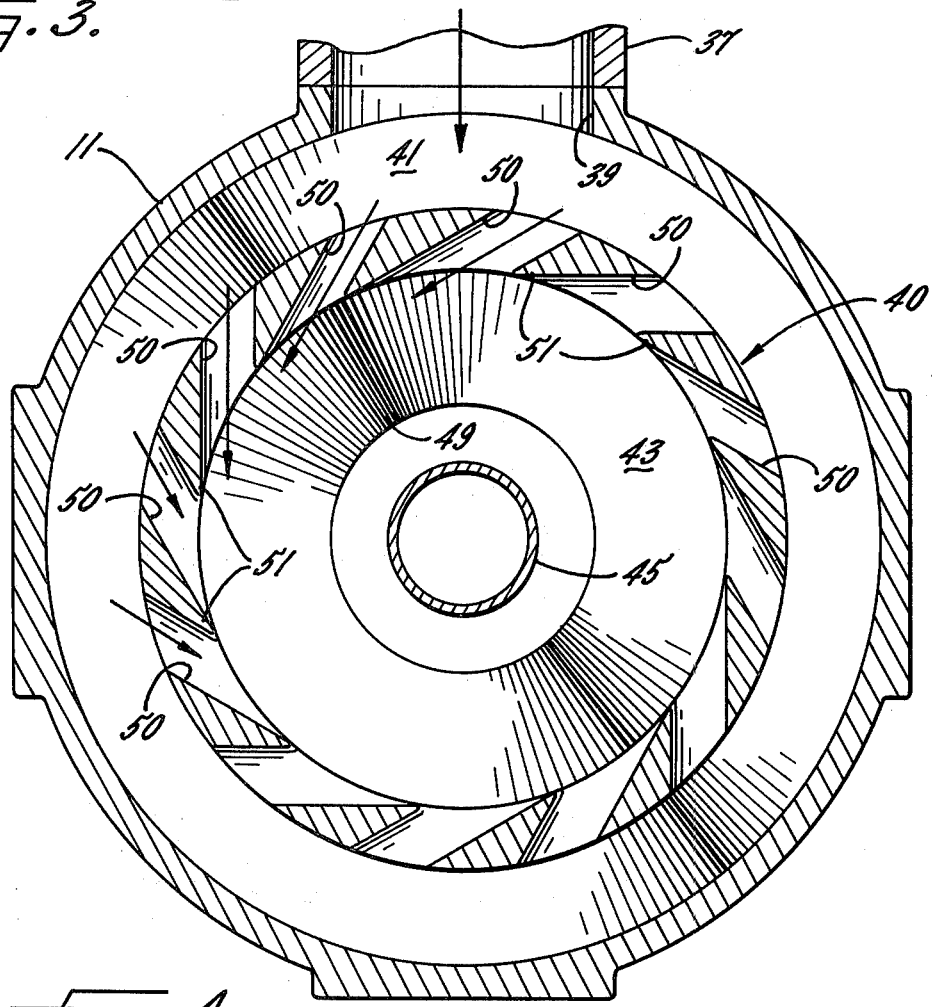
FIG. 4 is an enlarged fragmentary cross-section taken substantially along the line 4—4 of FIG. 1.

Air for supporting combustion of the fuel is supplied by a blower (not shown) and is delivered into the burner body 11 through a pipe 37 (FIG. 1). The latter is connected to a radially extending opening 39 (FIG. 4) formed in the body 11 and thus the combustion air enters the body in a radial direction.

The burner 10 as described thus far is conventionally referred to as a high velocity burner in that the restricted nozzle 17 at the downstream end of the burner block 15 serves to radially contract the fuel-air mixture and causes the flame to be discharged from the block with substantial velocity. For several years, the assignee of the present invention has marketed high velocity burners of this type for use with gaseous fuels and, when so used, the burners have performed with admirable results. Difficulty has been encountered, however, in successfully using such a burner with fuel oil as well as gas. As a result of incomplete combustion of the fuel oil, carbon deposits tend to accumulate within the burner block 15 and particularly at the discharge nozzle 17. Such deposits can quickly restrict the nozzle to such a degree as to detrimentally affect the performance of the burner.

The present invention contemplates the provision of a unique dual fuel, high velocity burner 10 of the foregoing type which effects more complete combustion of the fuel so as to reduce and virtually eliminate the accumulation of carbon deposits within the burner block 15 and at the discharge nozzle 17. In large, this is achieved by rotationally spinning the combustion air as it enters the combustion area and by forming the fuel and air mixture into a vortical swirl which imparts a high rotational velocity to the flame as the flame moves within and is discharged from the burner block. The spinning combustion air promotes faster vaporization of the fuel oil, effects more complete mixing of the fuel and air, creates an oil-resistant layer of protective air around the wall 16 and nozzle 17 of the burner block, and causes intermediate species of combustion to be recirculated into the flame envelope or reaction zone to promote faster combustion. As a result, the burner may be operated "rich" or with a very low amount of excess combustion air and yet virtually no carbon will build up within the burner block 15 or at the high velocity discharge nozzle 17.

More specifically, spinning of the combustion air herein is effected through the provision of an annular partition 40 within the burner body 11. The partition is cast integrally with the body and serves to divide the interior of the body into an outer chamber 41 and an inner chamber 43. The forward or downstream end of the partition 40 is joined to the body 11 and thus the downstream end of the outer chamber 41 is closed by the body and the partition (see FIG. 1). A radially extending wall 44 (FIG. 2) is formed integrally with the upstream end of the partition and substantially closes off the upstream end of the inner chamber 43 while the downstream end of such chamber is left open and is in direct communication with the burner block 15. The wall 44 is spaced slightly forwardly of the cover plate 13, which serves to substantially close the upstream of the outer chamber. The cover plate is suitably apertured to receive the forward end portion of the housing 21 while the wall 44 is apertured to receive a tube 45 (FIG. 2) which is telescoped over the sleeve 24 and projects forwardly beyond the nozzles 25 and 31. The tube 45 is fixed rigidly to the wall 44 and is spaced radially outwardly from the sleeve 24 so as to leave an annular passage 46 between the tube and the sleeve. A small amount of combustion air may flow from the outer chamber 41, through the space or passage 46a (FIG. 2) between the cover plate 13 and the wall 44, and then into the passage 46 to enable retention of the flame at low rates of fuel flow.

As shown in FIG. 2, the partition 40 includes a substantially cylindrical rear portion 47 and a substantially frusto-conical forward portion 49 which converges inwardly upon progressing forwardly. Formed around and extending through the cylindrical portion 47 of the partition 40 are several equally spaced passages 50 (FIGS. 2 and 3) which establish communication between the outer and inner chambers 41 and 43. The passages extend generally tangentially of the tube 45 and cause the cylindrical portion 47 of the partition to be formed with inwardly tapered vanes 51 (FIG. 3) for directing the flow of combustion air, the sides of the vanes also extending generally tangentially of the tube.

With the foregoing arrangement, combustion air from the pipe 37 enters the outer chamber 41 in a generally radial direction and then flows into the inner chamber 43 through the passages 50. As the air passes from the outer chamber to the inner chamber, the vanes 51 impart a rotational spinning motion to the air. The spinning air then encounters the inwardly converging forward portion 49 of the partition 40 and is discharged forwardly out of the inner chamber as a forwardly directed vortical spiral. The spiraling air picks up and mixes with the fuel emerging from the forward end of the tube 45 and causes the fuel and the resultant flame to swirl vortically upon passing within the burner block 15. Accordingly, the combustion air imparts a high rotational velocity to the flame and, as the flame passes through the discharge nozzle 17, its forward linear velocity is increased substantially. Thus, the flame emerges from the nozzle with both a high rotational velocity and a high linear velocity. When viewed from the end of the discharge nozzle, the flame appears to have a hollow center or core and appears to thread helically out of the nozzle with a corkscrew-like motion.

The swirling combustion air emerging from the inner chamber 43 helps atomize the fuel oil being discharged from the nozzle 31 and thus the oil vaporizes and ignites more quickly to promote faster and more complete combustion of the oil. Also, the swirling air mixes thoroughly with the vaporized oil to enable the oil to burn cleanly even in the presence of low excess air (i.e., when the air and oil are at near stochiometric proportions). As the air swirls through the burner block 15, a comparatively high percentage of the air flows directly adjacent the wall 16 and thus establishes along the wall a layer which is resistant to penetration by oil film. Accordingly, the air layer tends to protect against the formation of carbon deposits within the burner block. Such deposits also are minimized by virtue of the fact that the vortical swirl within the burner block causes intermediate species of combustion to be recirculated within the flame envelope. This promotes a faster reaction between the fuel and air and thus results in cleaner burner. Hence, the wall 16 and the discharge nozzle 17 will remain relatively free of carbon. Also, due to the high rotational velocity of the flame, the mass flow through the discharge nozzle 17 is greater than classical converging flow nozzle calculation would predict.

I claim:

1. A dual fuel, high velocity burner comprising a tubular body having a rear upstream end and a forward downstream end, an annular partition within said body and dividing the latter into inner and outer chambers, said inner chamber being open at the downstream end of said body and said outer chamber being substantially closed at the downstream end of said body, both of said chambers being substantially closed at the upstream end of said body, a tube extending axially within the central portion of said inner chamber, first means within said tube for delivering a flow of gaseous fuel through said tube for ignition of such fuel into a flame adjacent the downstream end of said body, second means within said tube for alternatively delivering a flow of liquid fuel and atomizing air through said tube for atomization and ignition of such fuel into a flame adjacent the downstream end of said body, a source of forced combustion air communicating with said outer chamber between the ends thereof to produce a generally circumferential flow of air within said outer chamber, a series of passages formed through and spaced circumferentially around said partition and extending substantially tangentially of said tube to impart a rotational spinning motion to the combustion air flowing from said outer chamber to said inner chamber through said passages, said inner chamber converging inwardly upon progressing toward the downstream end of said body so as to form the spinning combustion air into a vortical swirl which flows out of the open end of said inner chamber and imparts a swirling motion to said fuel and said flame, a tubular burner block secured to the downstream end of said body and having a generally cylindrical internal wall communicating with and extending a substantial distance beyond the open end of said inner chamber so as to receive the swirling stream from said inner chamber, and an inwardly converging internal wall at the downstream end of said cylindrical wall and defining a central discharge nozzle for radially contracting the swirling stream and increasing the forward velocity thereof.

2. A dual fuel, high velocity burner as defined in claim 1 in which the upstream end portion of said partition is generally cylindrical while the downstream end portion of said partition is generally frusto-conical, said passages being formed in the cylindrical portion of said partition, said passages being separated by inwardly tapered vanes whose sides extend substantially tangentially of said tube.

3. A dual fuel, high velocity burner as defined in claim 1 in which said first means comprise a sleeve telescoped into and spaced radially inwardly from said tube and adapted to receive a flow of gaseous fuel, a nozzle on the downstream end of said sleeve and having a series of circumferentially spaced ports for enabling the gaseous fuel to pass from said sleeve and into said burner block, the closed end of said inner chamber being spaced forwardly from the closed end of said outer chamber to leave a passage between the closed ends of said chambers, said passage communicating with the space between said tube and said sleeve to enable combustion air from said outer chamber to pass into and through said space.

4. A dual fuel, high velocity burner comprising a tubular body having a rear upstream end and a forward downstream end, an annular partition within said body and dividing the latter into inner and outer chambers, said inner chamber being open at the downstream end of said body and said outer chamber being substantially closed at the downstream end of said body, both of said chambers being substantially closed at the upstream end of said body, a tube extending axially within the central portion of said inner chamber, first means within said tube for delivering a flow of gaseous fuel through said tube for ignition of such fuel into a flame adjacent the downstream end of said body, second means within said tube for alternatively delivering a flow of liquid fuel and atomizing air through said tube for atomization and ignition of such fuel into a flame adjacent the downstream end of said body, a source of forced combustion air communicating with said outer chamber between the ends thereof to produce a generally circumferential flow of air within said outer chamber, a series of passages formed through and spaced circumferentially around said partition and extending substantially tangentially of said tube, adjacent passages being separated by an inwardly tapered vane whose sides extend substantially tangentially of said tube whereby said vanes impart a rotational spinning motion to the combustion air flowing through said passages from said outer chamber to said inner chamber and said air imparts a spinning motion to said fuel as the air is discharged from the downstream end of said body, a tubular burner block secured to the downstream end of said body and having a generally cylindrical internal wall communicating with and extending a substantial distance beyond said body so as to receive the spinning stream of fuel and combustion air from said body, and an inwardly converging internal wall at the downstream end of said cylindrical wall and defining a central discharge nozzle for radially contracting the swirling stream and increasing the forward velocity thereof.

* * * * *